US007726958B2

(12) United States Patent
Pedersen et al.

(10) Patent No.: US 7,726,958 B2
(45) Date of Patent: Jun. 1, 2010

(54) HYDRAULIC MACHINE

(75) Inventors: Joergen Pedersen, Nordborg (DK); Hans Christian Petersen, Nordborg (DK); Claus Johansen, Soenderborg (DK)

(73) Assignee: Sauer-Danfoss Aps, Nordborg (DK)

( * ) Notice: Subject to any disclaimer, the term of this patent is extended or adjusted under 35 U.S.C. 154(b) by 617 days.

(21) Appl. No.: 11/635,948

(22) Filed: Dec. 8, 2006

(65) Prior Publication Data

US 2007/0134119 A1 Jun. 14, 2007

(30) Foreign Application Priority Data

Dec. 10, 2005 (DE) ..... 10 2005 058 911

(51) Int. Cl.
*F03C 2/00* (2006.01)
*F03C 4/00* (2006.01)

(52) U.S. Cl. ..... 418/61.3; 418/171; 418/225

(58) Field of Classification Search ..... 418/54, 418/61.1–61.3, 171, 166, 225, 229
See application file for complete search history.

(56) References Cited

U.S. PATENT DOCUMENTS

| | | | |
|---|---|---|---|
| 3,915,603 | A | 10/1975 | Swedberg |
| 3,930,766 | A | 1/1976 | Swedberg |
| 4,008,015 | A | 2/1977 | McDermott |
| 4,087,215 | A | 5/1978 | Miller |

FOREIGN PATENT DOCUMENTS

| | | |
|---|---|---|
| CA | 1012412 | 6/1977 |
| DE | 2 421 304 | 11/1974 |
| DE | 2732086 | 1/1978 |

*Primary Examiner*—Theresa Trieu
(74) *Attorney, Agent, or Firm*—McCormick, Paulding & Huber LLP

(57) ABSTRACT

A hydraulic machine has a gear wheel (2) with outwardly extending teeth and a gear ring (4) with inwardly extending teeth formed by rollers each of which is supported in a pocket (8) in the gear ring, and pressurized spaces are formed between the gear wheel and the inwardly extending teeth.

To keep the wear of the machine small each pocket (8) has at least two different radii (R1, R2, Rn) whereby a radius (R2, Rn) at a smaller displacement from the edge (12) of the pocket is larger than a radius (R1) at a larger displacement from the same edge (12) of the pocket (8).

10 Claims, 2 Drawing Sheets

HYDRAULIC MACHINE

CROSS REFERENCE TO RELATED APPLICATIONS

Applicant hereby claims foreign priority benefits under U.S.C. §119 from German Patent Application No. 10 2005 058 911.1 filed on Dec. 10, 2005 the contents of which are incorporated by reference herein.

FIELD OF THE INVENTION

The invention concerns a hydraulic machine with a gear wheel having outwardly extending teeth and a gear ring having inwardly extending teeth, with the inwardly extending teeth being formed by rollers each of which is located in a corresponding pocket in the gear ring, and wherein pressurized spaces are formed between the gear wheel and the inwardly extending teeth.

BACKGROUND OF THE INVENTION

Such a hydraulic machine is known for example from U.S. Pat. No. 3,915,603. The gear wheel rotates and orbits during operation. Between the rollers and the gear wheel the pressurized spaces are formed, of which spaces about one half are filled with hydraulic fluid under high pressure and the remaining half are filled with hydraulic fluid under lower pressure. The engagement between the rollers and the gear wheel must especially provide sealing at two positions; namely, at the two points of separation between a high-pressure space and an adjacent low-pressure space.

At one of these points of separation, the boundary between the high-pressure and low-pressure spaces is formed by one roller together with the peak of a tooth of the gear wheel. This roller is subjected to an especially high loading. This roller is not only pressed into its pocket by the gear wheel, but also the pressure of the high-pressure space acts on the roller to, so to speak, "urge" the roller out of its pocket in the circumferential direction. In this situation, the engagement surface area between the roller and the pocket is diminished so that a higher pressure is exerted on the roller. This higher pressure is especially detrimental if the roller is engaging practically only on the edge of its pocket, where the pocket transitions to the inner surface of the gear ring in the circumferential direction. Under unfavorable conditions this can lead to the edge making a permanent impression in the roller. Then this impressed roller tends to stand still while all the other loaded rollers rotate in normal fashion. If the roller stands still then no rolling contact occurs between the gear wheel and the roller, and the wear of these components is disproportionately large. Even without the formation of such an impression, in most cases a considerable wear, either of the edge of the pocket or of the roller, still results. This wear impairs the sealing ability of the machine and accordingly the machine's efficiency and useful life.

The above mentioned U.S. Pat. No. 3,915,603 has tried to solve this problem by forming the pocket with a larger radius than the roller, so that the roller in certain situations can yield to the pressure from the higher-pressure space. This however, leads to the fact that the point of separation between the high-pressure space and the low-pressure space is not absolutely sealed, which can lead to internal leakage. To avoid this leakage, expensive measures securing the pressure delivery to the pocket are required.

Also in U.S. Pat. No. 3,930,766, the pockets have been formed with larger radii than the rollers, which again brings with it sealing problems.

U.S. Pat. No. 4,008,015 shows a construction in which the pockets again have a larger radii than the ball. To accommodate the radii-difference the pocket is lined with a filling formed by a porous material. This porous material can absorb hydraulic fluid and thereby offer an improved lubrication.

SUMMARY OF THE INVENTION

The present invention has as a basic object to hold the wear in a hydraulic machine to a small value.

This object is solved in a hydraulic machine, of the above-mentioned type, in that each pocket has at least two different radii, with one radius at a small spacing from the edge of the pocket being larger than a radius at a larger spacing from the same edge of the pocket.

With such construction, in a middle region of the pocket, the radius of the pocket can be made exactly as large as the radius of the roller, with only a certain play being provided to make sure that the roller can rotate without hindrance. This play is, however, very small; in the order of, for example, two to three hundredths of a millimeter. Therefore, so long as the roller is essentially pressed into the middle of the pocket there results, because of the agreement of the radii of the pocket and the roller, an excellent seal-creating capacity. The associated force imposed on the roller by the gear wheel, which pushes the roller into the pocket, is moreover available during the largest portion of the cycle of the gear wheel because of the prevailing pressure relationships. If, on the other hand, the roller is subjected to a force urging it laterally of the pocket by the pressure in the high-pressure space, the roller can deflect toward the region of the packet with a larger radius. In this deflected position, the roller sees then a larger engagement surface area than if the roller were only engaging the edge of its pocket, so that the surface pressure between the gear ring and the roller is less than in the case of the engagement of the roller on the edge. The internal seal-creating capacity of the machine also remains practically unchanged. Also due to the deflection of the roller, it is possible that the forces exerted on the roller will diminish so that the loading of the roll is also decreased.

Preferably the different radii extend from different axes. Thereby it is, in a simple way, possible to form the outer surface of the pocket, on which the roller lies, as a continuous surface. In other words, there are no corners or discontinuities in the outer surface of the pocket, so that the roller can freely move in the pocket under the influence of corresponding forces without the roller's movement being disturbed.

Preferably, the axes of the different radii lie on a circular line. This is an especially simple construction for the shifting of the axes, especially when more than two radii are used inside of the pocket.

Preferably, a radius in the middle of the pocket corresponds to the radius of the roller. This provides the best sealing capability. In this case no exact agreement of the radii is necessary. The radii are of similar enough sizes to achieve the sealing ability.

Preferably, the pocket has, with respect to its middle plane in the circumferential direction, two symmetrical halves. The machine can then be driven in similar ways in both rotation directions. The finishing of the pockets is also simplified.

Preferably a middle circumferential section of the pocket has a constant radius. In this case upon being loaded the roller lies radially outwardly against the gear ring not only along a line, but over a certain surface area. This improves the sealability because the sealing zone is increased in the circumferential direction.

Preferably, the middle circumferential section extends over the range of from ±30° to 60°. If the pocket in the circumferential direction extends more than 180°, that is, with reference to the middle plane of the pocket in the circumferential direction, the pocket extends more than ±90°, then about a third up to a half of the total extent of the pocket has a constant radius which proceeds from the same middle point, so that there is a correspondingly large sealing length. The remainder of the pocket serves to provide the roller with the necessary deflecting moveability.

Preferably, the pocket has a planar surface connected to each of its edges. This further reduces the risk that the roller comes into contact with an edge of the pocket.

Preferably, the inner end of the planar surface lies on a first radial ray proceeding from the axis of the largest radius, which first radial ray with a second radial ray, which stands perpendicularly to a third radial ray that divides the pocket into halves, includes a first angle in the range of from 1° to 6°. In other words the planar surface begins inside of a "half circle" which describes the pocket. This is sufficient for the movement of the roller inside of the pocket.

Preferably, the planar surface extends to the edge of the pocket at a second angle in the range of from 1° to 6° relative to the third radial ray. The planar surface is therefore somewhat outwardly inclined.

Preferably, the first angle and the second angle are of the same size. This simplifies the finishing.

BRIEF DESCRIPTION OF THE DRAWINGS

In the following, the invention is described in connection with the drawings by way of preferred embodiments. The drawings are.

DETAILED DESCRIPTION OF THE INVENTION

Figure 1:
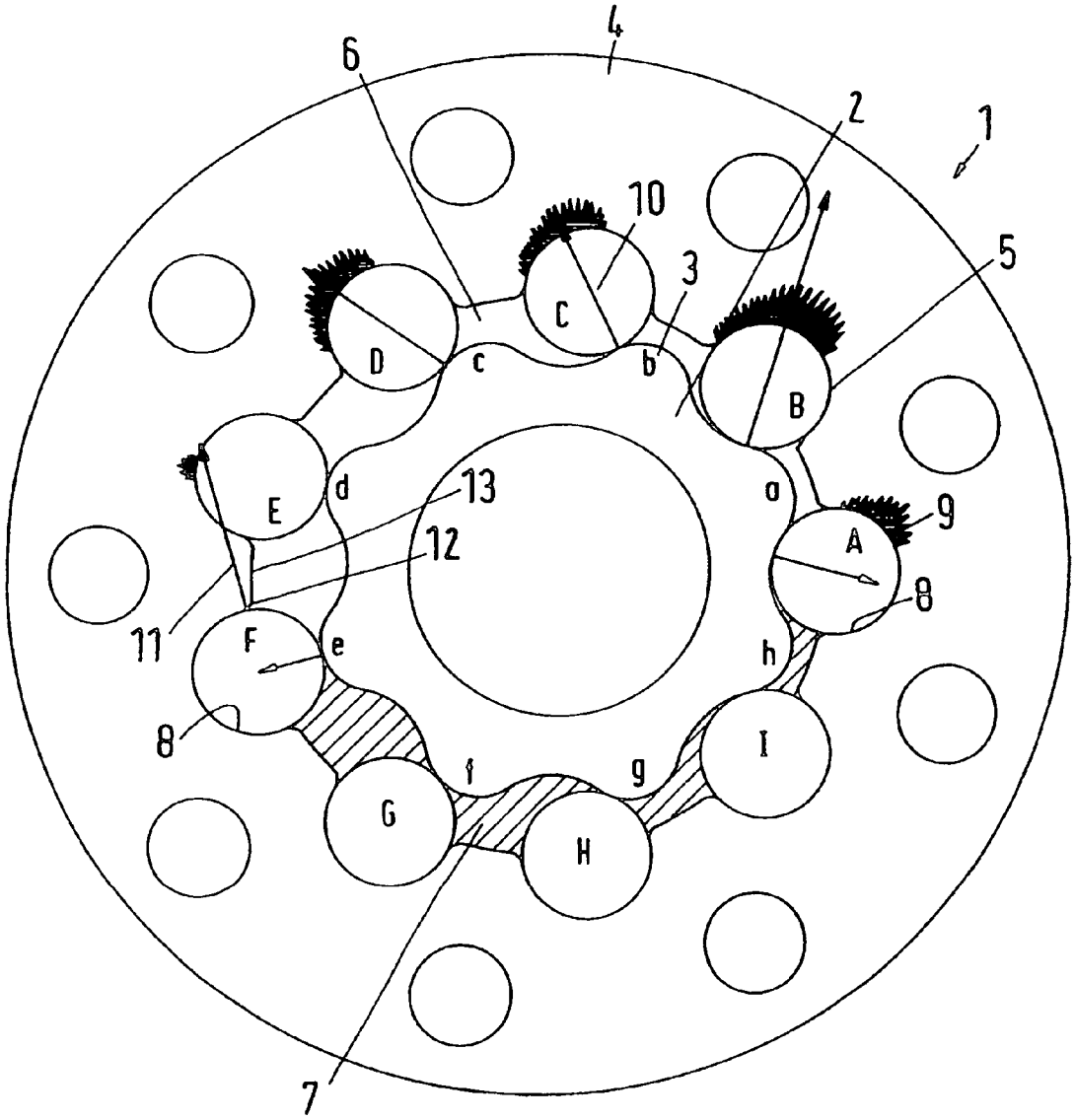
FIG. 1—is a schematic cross sectional view of a hydraulic machine.

FIG. 1 shows in schematic illustration a hydraulic machine 1 in cross section, more particularly a displacement section of the hydraulic machine 1. The machine 1 has a gear wheel 2 which, in the present example, has eight teeth 3. To distinguish the teeth from one another they are marked with the letters a-h. The gear wheel 2 is arranged inside of a gear ring 4 which has nine inwardly extending teeth 5 in the form of rollers A-I. The gear ring 4, therefore, has one tooth 5 more than the gear wheel 2 has outwardly extending teeth 3.

In operation, the gear wheel 2 rotates and orbits inside of the gear ring 4 in a way known manner. As long as no pressure prevails, the gear wheel 2 lies on all of the inwardly extending teeth 5. As soon as the operating pressure prevails, a tight sealing engagement principally occurs only at two positions to form a separation between a low pressure region 6 and a high pressure region 7. The high pressure region 7, for purposes of illustration, is indicated by cross hatching.

In the illustrated embodiment, and in the illustrated position of the gear wheel 2 in the gear ring 4, one of the seals must be placed between the inwardly extending tooth A and a region of the gear wheel 2 between the outwardly extending teeth a and h. On an approximately opposite side, the other seal is required between the peak of the outwardly extending tooth e and the peak of the inwardly extending tooth F.

If the machine 1 is used as a motor, then the high pressure region 7 is supplied with hydraulic fluid under pressure. In this case, the pressure in the high pressure region leads to the gear wheel 2 being simultaneously rotated and orbited within the gear ring 4. If the machine 1 is used as a pump, then the gear wheel 2 is driven externally and displaces hydraulic fluid under pressure from the high pressure region 7.

The inwardly extending teeth of 5 as mentioned above are formed by rollers A-I, which are rotatably supported in pockets 8. To aid in the following description, pressure regions 9 at which the highest surface pressures occur when the rollers A-F are pressed into the pockets 8 are indicated in black in the drawing. Arrows 10 give schematically the direction and the strength of the forces at which the gear wheel 2 exerts itself on the rollers A-F. These forces are actually made up by the effects of the hydraulic pressure from the high pressure region 7. Under static conditions and ideally, that is, without friction, the sum of all the contact forces (arrows 10) equals the hydraulic force on the gear wheel.

The roller F is, by the pressure in the high pressure region 7, loaded to a certain amount in the direction of the arrow 11. The roller F is the roller which stands shortly in front of a sealing or loading change. Upon a further rotation of the gear wheel 2 with respect to the gear ring 4, the boundary between the low pressure region 6 and the high pressure region 7 transitions to another roller.

The force (arrow 11) exerted by the pressure in the high pressure region 7 on the roller F leads to the roller F being urged out of its pocket 8. With this force there exists the danger that the roller F will come into contact with an edge 12, at which edge 12 the pocket 8 transitions to the inner wall 13 of the gear ring 4. With this force, the edge 12 can press into the circumference of the roller F. Also this roller F is inclined to jam while all the other rollers rotate. If the roller F stands still no rolling contact occurs between the gear wheel 2 and the roller F, and the wear of the gear wheel 2 and of the roller F is disproportionately large. In any event, there results an increased wear of the pocket edge and/or of the roller F. Since this situation can ultimately appear at all of the rollers A-I, there results a wear of all of the rollers A-I. This wear reduces useful life and also efficiency.

Figure 2:
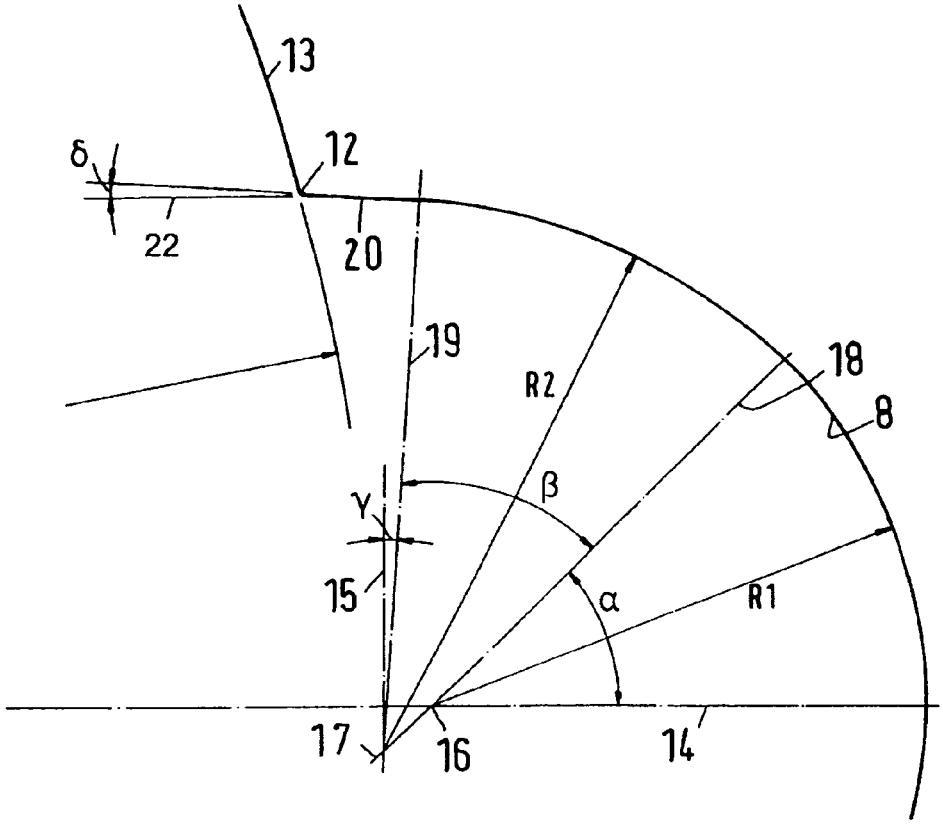
FIG. 2—is a schematic illustration of the construction of a pocket.

To deal with this problem the pocket 8 is now provided with a special conformation which will be explained with reference to FIG. 2.

Illustrated is a pocket 8 which transitions to the interior wall 13 of the gear ring 4 by way of the edge 12.

To simplify the following explanation a plane 14 is indicated which, in the circumferential direction, splits the pocket 8 in half. A radial ray 15 stands perpendicularly on the plane.

The pocket 8 has a middle region which, starting from the plane 14, extends for a range of ±30° to 60° with a radius R1. This radius R1 corresponds essentially to the radius of the rollers A-I. In the present example, the pocket 8 has the radius R1 throughout an angular region extending from −45° to +45° with reference to the plane 14. The radius R1 in this case proceeds from a central axis 16 which lies in the plane 14.

To the first region (angle $\alpha$) is connected a second region which extends over an angle $\beta$. In this region (angle $\beta$) the pocket has a radius R2 which is larger than the radius R1. This radius R2 proceeds from a central axis 17 which is displaced from the central axis 16 along a separating plane 18 which separates the first region (angle $\alpha$) from the second region (angle $\beta$). The central axis 17 therefore is no longer located in the plane 14.

Because of the mutual displacement of the central axes of the radii R1, R2, no step or discontinuity appears at the transition of the individual cylindrical surfaces of the pocket 8 defined by the radii R1 and R2. The transition therefore occurs "softly" so that a smooth off-rolling of the rollers A-I is assured in the pockets 8.

The second region (angle β) does not extend entirely to the radial ray 15 standing perpendicularly to the plane 14. The second region ends at a spacing in advance of this radial ray 15 which spacing is defined by an angle γ. The angle γ has a size in the range of 1° to 6°. The second region (angle β) ends therefore at a separating plane 19. Adjacent to this separating plane 19 in the circumferential direction is a planar section 20 that defines an angle δ with plane 14. The angle δ has a size in the range of 1° to 6°. The angle δ is preferably exactly the same size as the angle γ. For clarifying the relationship, a straight line 22 is shown which runs parallel to the plane 14.

In the case of a gear ring 4 having an interior radius of about 31 mm, the radius R1 has a length of about 8 mm and the radius R2 has a length of about 9.3 mm. The angle α amounts to a 45°. The angle β amounts to 42°. The angle γ and the angle δ each amount to 3°.

Figure 3:
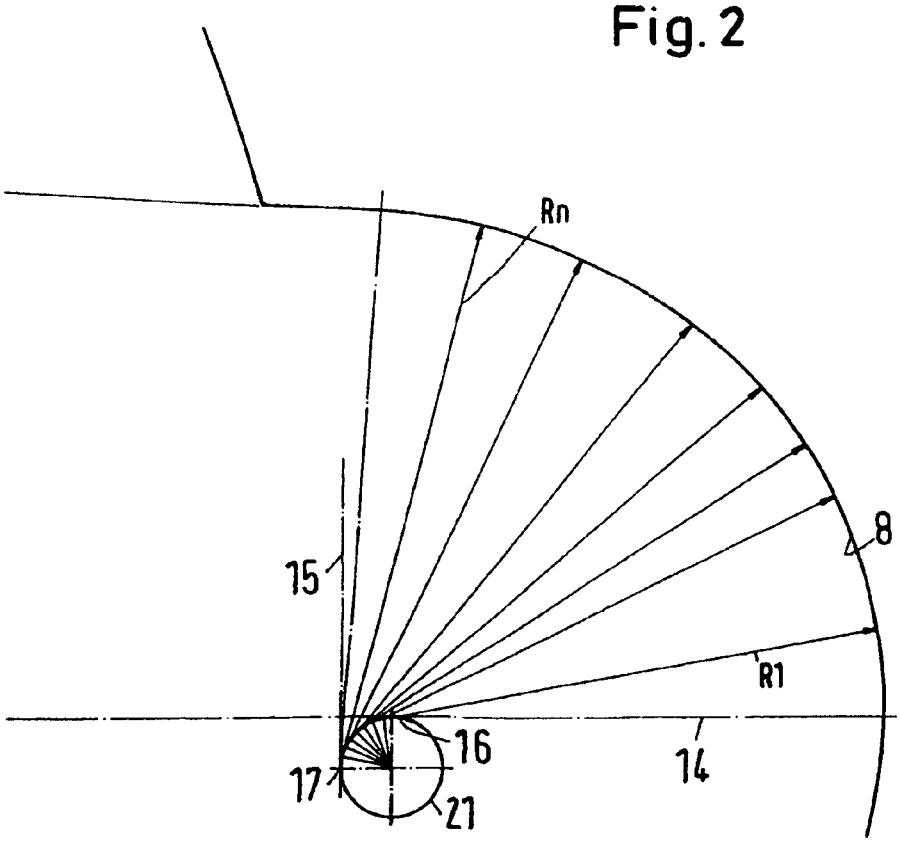
FIG. 3—is a schematic illustration of the construction of a modified pocket.

FIG. 3 shows a modified embodiment, in which the radius of the pocket 8 increases steadily from a radius R1 to a radius Rn. The radii proceed from central axes all of which lie on a circle 21. Also here the radius R1 at the plane of 14 corresponds to the radius of rollers A-I. The largest radius Rn is then about ten to twenty percent larger than the radius R1.

From the illustrated distributions of radii modifications can be made in several respects. One can, as illustrated in FIG. 2, provide two regions of the pocket having different radii R1, R2. Naturally one can also have more than the two illustrated regions per pocket with the radii becoming larger as they approach the edge 12. One can, as illustrated in FIG. 3, provide a continuous enlargement of the radii. One can also combine both of these possibilities with one another; that is, provide in the region of plane 14 a region with a constant radius and then somewhat farther away from the plane 14 enlarge the radius continuously.

In each case, one achieves with one of such conformations that the middle regions of the pockets 8 offers an excellent sealing with the rollers A-I, with each pocket at the same time permitting a deflecting movement of its roller so as to avoid an exceedingly high wear.

As mentioned above the contact point of a roller with its pocket 8 should never move beyond a plane defined by the radial ray 19. Therefore, in principal, it is unimportant as to how the connection between the end of the curved portion and the edge 12 is made. If this connection, however, is directed tangentially to the curvature, as with the plane 20, then the arrangement will also tolerate an exceeding of the radial ray 19 by the roller. The edge 12, for practical reasons is often rounded or beveled.

While the present invention has been illustrated and described with respect to a particular embodiment thereof, it should be appreciated by those of ordinary skill in the art that various modifications to this invention may be made without departing from the spirit and scope of the present invention.

The invention claimed is:

1. A hydraulic machine with a gear wheel having outwardly extending teeth and a gear ring having inwardly extending teeth, wherein the inwardly extending teeth are formed by rollers each of which is supported in a pocket in the gear ring, wherein the gear wheel forms pressure chambers with the inwardly extending teeth, wherein each pocket has at least two different radii, whereby a radius having a smaller spacing to an edge of the pocket is larger than a radius having a larger spacing from the same edge of the pocket, and wherein the radii proceed from different axes.

2. The hydraulic machine according to claim 1, wherein the axes lie on a circular line.

3. The hydraulic machine according to claim 1, wherein the pocket with respect to its middle plane in a circumferential direction has two mirror symmetrical identical halves.

4. The hydraulic machine according to claim 1, wherein a middle circumferential section α of the pocket has a constant radius.

5. The hydraulic machine according to claim 4, wherein the middle circumferential section α has an extent in the range of ±30° to 60°.

6. A hydraulic machine with a gear wheel having outwardly extending teeth and a gear ring having inwardly extending teeth, wherein the inwardly extending teeth are formed by rollers each of which is supported in a pocket in the gear ring, wherein the gear wheel forms pressure chambers with the inwardly extending teeth, wherein each pocket has at least two different radii, whereby a radius having a smaller spacing to an edge of the pocket is larger than a radius having a larger spacing from the same edge of the pocket, and wherein a radius in the middle of the pocket corresponds to a radius of the roller.

7. A hydraulic machine with a gear wheel having outwardly extending teeth and a gear ring having inwardly extending teeth, wherein the inwardly extending teeth are formed by rollers each of which is supported in a pocket in the gear ring, wherein the gear wheel forms pressure chambers with the inwardly extending teeth, wherein each pocket has at least two different radii, whereby a radius having a smaller spacing to an edge of the pocket is larger than a radius having a larger spacing from the same edge of the pocket, and wherein the pocket at each of its edges is connected to a planar surface.

8. The hydraulic machine according to claim 7, wherein an inner boundary of the planar surface lies on a first radial ray proceeding from the axis of the largest radius, which radial ray encloses a first angle γ in a range of 1° to 6° with a second radial ray standing perpendicular to a third radial ray which divides the pocket into halves.

9. The hydraulic machine according to claim 7, wherein the planar surface encloses a second angle δ in the range of 1° to 6° with a plane which divides the pocket into halves.

10. The hydraulic machine according to claim 9 wherein the first angle γ and the second angle δ are of the same size.

* * * * *